United States Patent [19]

Mahaffy et al.

[11] Patent Number: 4,819,409

[45] Date of Patent: Apr. 11, 1989

[54] APPARATUS FOR FORMING AN ADHESIVE SEALED PACKAGE

[75] Inventors: Reid A. Mahaffy, Montclair; George W. Anderson, Little Falls, both of N.J.; Eugene Garson, Bronx, N.Y.; John A. Giordano, West Paterson, N.J.; Robert E. Hirt, Waldwick, N.J.; Milan R. Ostrow, Pequannock, N.J.

[73] Assignee: Mahaffy & Harder Engineering Co., Fairfield, N.J.

[21] Appl. No.: 138,648

[22] Filed: Dec. 28, 1987

Related U.S. Application Data

[63] Continuation of Ser. No. 56,642, Jun. 1, 1987, abandoned, which is a continuation of Ser. No. 910,406, Sep. 22, 1986, abandoned, which is a continuation of Ser. No. 663,866, Oct. 23, 1984, abandoned.

[51] Int. Cl.[4] ..... B65B 7/28; B65B 51/02

[52] U.S. Cl. ..... 53/282; 53/383; 53/371; 222/108

[58] Field of Search ..... 53/383, 371, 282; 222/108

[56] References Cited

U.S. PATENT DOCUMENTS

| | | | |
|---|---|---|---|
| 2,709,539 | 5/1959 | Swanson | 222/108 |
| 2,874,733 | 2/1959 | Sesler | 222/108 X |
| 3,831,342 | 8/1974 | Rejsa | 53/383 X |
| 3,879,917 | 4/1975 | Bassendale | 222/108 X |
| 3,981,123 | 9/1976 | Flanagan | 53/383 X |
| 4,369,613 | 1/1983 | Gess | 53/383 X |
| 4,416,213 | 11/1983 | Sakiya | 118/52 |
| 4,483,462 | 11/1984 | Heintz | 222/108 X |

*Primary Examiner*—John Sipos

*Attorney, Agent, or Firm*—Parmelee, Bollinger & Bramblett

[57] ABSTRACT

A method and apparatus are provided for packaging products between first and second plastic components sealed by using a hot melt adhesive applied by a dispensing applicator in one of several serially arranged stations of a packaging operation. The first plastic component is supported for indexing movement on a transport and moved under a hot melt applicator which is continuously driven in a predetermined path of travel which traverses the entire periphery of the product-loaded first plastic component. The first plastic component is stopped under the applicator for a predetermined dwell time during which the applicator dispenses the hot melt adhesive, then advanced to a position where the second plastic component is applied to form a filled package which is the evacuated and sealed. Apparatus is provided for preventing dripping or stringing of the hot melt adhesives.

3 Claims, 8 Drawing Sheets

14
12
80
82
84
40

12
32
82

10
12
20
30
24
22
28
16
74
18
36
34

24
86
90
92
12
VACUUM
88
36
24
12
20
96
14
94
90
COMPRESSED
AIR OR INERT
GAS
98
100
94
36
24
VACUUM

APPARATUS FOR FORMING AN ADHESIVE SEALED PACKAGE

This application is a continuation of application Ser. No. 56,642 filed June 1, 1987 now abandoned which is a continuation of application Ser. No. 910,406 filed Sept. 22,1986 now abandoned which is a continuation of application Ser. No. 663,866 as filed on Oct. 23, 1984, now abandoned.

BACKGROUND OF THE INVENTION

This invention relates to a method and apparatus for packaging by forming adhesively sealed packages. More particularly, this invention relates to a method and apparatus for automatically forming packages using two webs of plastic material and a hot melt adhesive applied along a seal-line.

U.S. Pat. No. 3,061,984 illustrates packaging apparatus of known type for making hermetically-sealed vacuum packages using heat sealing to weld together two webs of plastic packaging material to form the packages. In carrying out this method of package formation, the inner surfaces of each of the two webs of packaging material typically will be of the same composition or otherwise compatible to be able to be welded by heating.

It later became common practice in vacuum-packaging sliced luncheon meats and the like to use as one of the two webs plastic material of much heavier caliber and of greater stiffness, e.g. as shown and described in U.S. Pat. No. 3,545,163. Such packages were somewhat difficult to open by hand Accordingly, sealants on the inner surfaces of the two webs forming the package were formulated so that the hermetic seal could be opened with a relatively low force by peeling the two package components apart.

The heat sealing methods described above have come into widespread use. The materials used in such packages typically are multilayered, often incorporating an inner layer whose only function is to provide the required heat sealing capability. Web back-forming, such as described in U.S. Pat. No. 3,545,163, has been employed with both flexible webs (1½ to approximately 5 mils thick) and semi-rigid webs (having a thickness in the range of 7 to 18 mils). Web backforming is capable of providing a package with a platform type appearance as illustrated in FIG. 4 of U.S. Pat. No. 3,229,810. Normally packages fabricated using two webs of flexible material do not include a back-formed component.

The prior art packages which have been described have for the most part been sealed by heating and welding the layers together or by interposing a plasticizer of pressure sensitive adhesive. Hot melt adhesives for sealing vacuum packages have found limited use, even though they offer certain advantages in reducing the cost of the packaging materials required, as well as in providing the ability to reclose and re-seal the packages after the initial opening.

Hot melt adhesives have been applied by several methods. One method includes applying the hot melted adhesive to one of two package components comprising a partially processed semi-rigid component with the application being made at a time well in advance of the actual packaging operation. In this method of packaging, the hot melt adhesive must be allowed to cool and then be reactivated at the time of sealing by using heat and pressure. This method is more expensive to carry out than a simple in-line adhesive application method, and has been practical only when used on semi-rigid material.

Another method for applying hot melt adhesive is through use of a rotogravure printer. This method has not been commercially satisfactory for packaging machines because of operational problems as well as the difficulty of printing on areas depressed below a web line or on three dimensional areas. Furthermore, since the process inherently involves continuous motion in performing the printing operation, problems exist in attempting to use the method on an intermittent-motion machine.

A further method, which has had limited commercial use, is the application of the adhesive by a hot melt adhesive applicator gun which may be stationary while the packages move past the gun; alternatively, the guns may be traversed over the desired patterns of the package, or a combination of these two approaches may be used. The traversing gun has represented the best technique since it requires only one gun per package being traversed. However, the guns and their carriers must be started and stopped in their traversing path once for every pattern being laid down. Accordingly, the acceleration as well as the stopping of the moving guns places an upper practical limit on the number of packages which can be processed in a given time period. Furthermore, the traversing equipment is complicated and expensive to manufacture and maintain.

It also is difficult to apply a thin line of hot melt adhesives without a break, skip or excessive overlap at the high traversing speeds required to first accelerate or begin application, and then to shut off and decelerate the applicator head all within one machine cycle. Due to the bulk of the apparatus in previous designs, it has been impractical to apply the hot melt adhesive immediately prior to sealing thereby requiring extensive reactivation of the adhesive with heat and pressure which makes the bonds between the package components less than optimum because of elapsed time, particularly in a typical refrigerated work room.

SUMMARY OF THE INVENTION

In carrying out this invention, in one illustrative embodiment thereof, a method and apparatus are provided for packaging products between first and second plastic components sealed by using a hot melt adhesive applied by a dispensing applicator in one of several serially arranged stations of a packaging operation. The first plastic component of the package is supported for indexing movement on a transporting means or is formed therein by known forming techniques and is moved under a hot melt applicator which is continuously driven in a predetermined path of travel which traverses the entire periphery of the first plastic component which is loaded with the product being packaged. The first plastic component is stopped under the path of travel of the applicator for a predetermined dwell time, while the applicator is actuated to apply the hot melt adhesive. The first plastic component is advanced and the second plastic component is applied thereover to form the package which then is evacuated and sealed by bringing the second plastic component into intimate contact with the hot melt adhesive surrounding the periphery of the first plastic component.

Means are provided for preventing the dripping of adhesive on or into the contents of the first plastic component during its indexing move between stations and contact is minimized between the first and second plastic components in the evacuation station to prevent adhesive contamination of the apparatus. This is accomplished in one embodiment by separating the first and second plastic components in the area of evacuation by spring biased web lifters, as by a spacing of not less than ⅜ of an inch from the opening through which the evacuation takes place. Alternatively, or in combination, gas pressure may be applied between the components causing the top plastic component of the package to tent upward in the critical evacuation area.

Advantageously, the first and second plastic components are formed of sheets of flexible plastic material, semirigid material or combinations of these materials. Furthermore, the second plastic component whether it be flexible or of a semi-rigid material may be back-formed in the apparatus.

Accordingly, it is an object of this invention to provide improved packaging apparatus and methods employing hot melt adhesives. Other objects, aspects and advantages of the invention will in part be pointed out in, and in part apparent from, the following description considered together with the accompanying drawings.

DESCRIPTION OF THE PREFERRED EMBODIMENTS

Before proceeding with a detailed description of the present invention, it should be pointed out that the invention relates to methods and apparatus employing hot melt applicators which are continuously driven. The applicators are driven continuously even though the packages which are being formed may be temporarily stationary or in indexing movement through the various packaging apparatus. The package components may involve either preformed trays, back-formed platforms and/or trays or platforms which are formed from two webs by the apparatus in one continuous process. The adhesive applicator is driven either separately or using the machine drive of the apparatus in which it is incorporated and may be applied and installed on a variety of packaging machines.

The adhesive applicator of the traversing gun type of the present invention will be described in connection with a packaging machine of the die train type as in the aforesaid U.S. Pat. No. 3,061,984 although it will be readily understood that it may be applied to other types of packaging machines, for example, to the type of machine described in U.S. Pat. No. 3,545,163 or with some modifications to packaging machines of the non-die train type which are in common use in the packaging industry.

Figure 1:
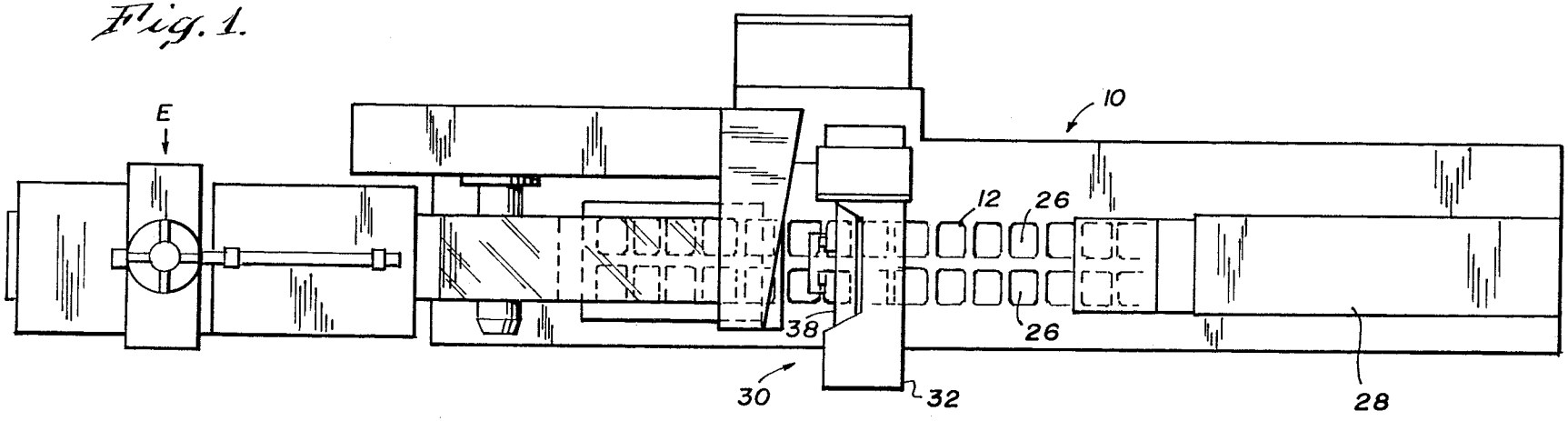
FIG. 1 is a top plan view of a packaging apparatus in accordance with the present invention.
Figure 2:
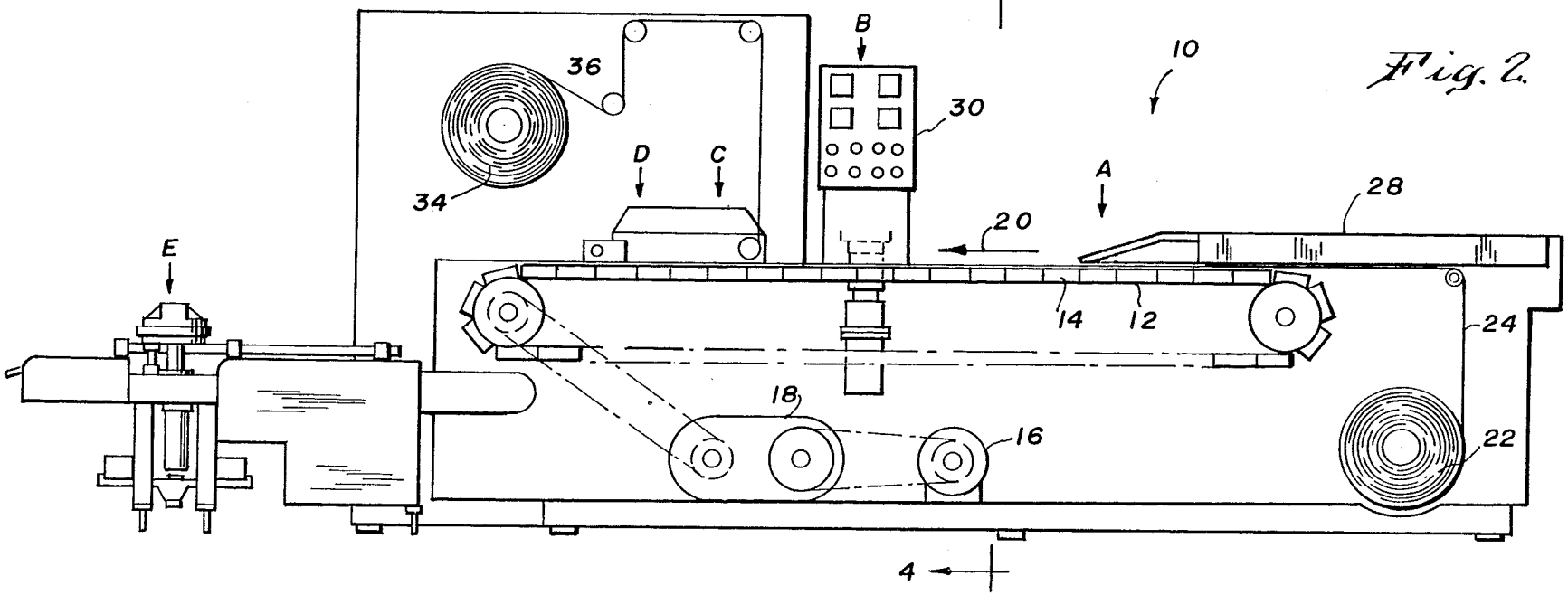
FIG. 2 is a side elevation of the packaging apparatus illustrated in FIG. 1.

Referring now to FIGS. 1 and 2, the packaging machine referred to generally with the reference character 10, uses a train of individual two-abreast dies 14 which are driven through the machine 10 past a plurality of work stations A, B, C, D, and E by drive motor 16 driving a Geneva drive 18 which in turn indexes the de train 12 through the packaging stations in the usual manner. The direction of the die train movement is indicated by the arrow 20 which will be referred to as the machine direction.

A display sideweb roll 22 feeds a web of suitable flexible or semi-rigid plastic to the die train 12 where a first plastic package component 26 is formed in the dies as described in previously mentioned U.S. Pat. No. 3,061,984. As has been pointed out, these first plastic package components 26 may be formed or may be preformed receptacles, etc.

A fed conveyor 28 transports the product to loading station A where the product to be packaged may be manually or machine loaded (not shown). The loaded first plastic package component 26 is then indexed to an adhesive applicator station B. The adhesive applicator station B includes an adhesive applicator, referred to generally with the reference character 30, which includes a stationary frame 32 straddling the die train 12.

Hot melt adhesive is applied b the adhesive applicator 30 forming an adhesive pattern around 360° of the perimeter of the first plastic packaging component 26, details of which will be given following the completion of a generalized description of the machine.

After passing through the applicator Station B, the die train 12 is indexed to Preliminary sealing Station C, along with a cover or second plastic package component 36, which is fed from the back side web roll 34 of suitable, flexible or semi-rigid plastic material in accordance with the requirement of the package being formed and where contact between package components 26 and 36 is completed around the majority of the perimeter of the adhesive pattern which has been applied to the first plastic package component 26. The package formed between the first plastic package component 26 and cover 36, is moved to evacuation Station D where the package is evacuated and where contact between package components 26 and 36 is completed on the remainder of the perimeter of the adhesive pattern. This completely seals the evacuated package. From there the sealed package is moved to a cutting Station E, where the package is finally cut and trimmed.

It should be noted that the adhesive applicator 30 is mounted downstream in the machine direction as far as possible adjacent the second plastic component 36 in position so that the hot melt adhesive will still be hot and molten as the packages enter the sealing station. The adhesive applicator embodying the present invention is well suited for this location because of its compactness and the fact that it is narrow in the machine direction 20.

Figure 3:
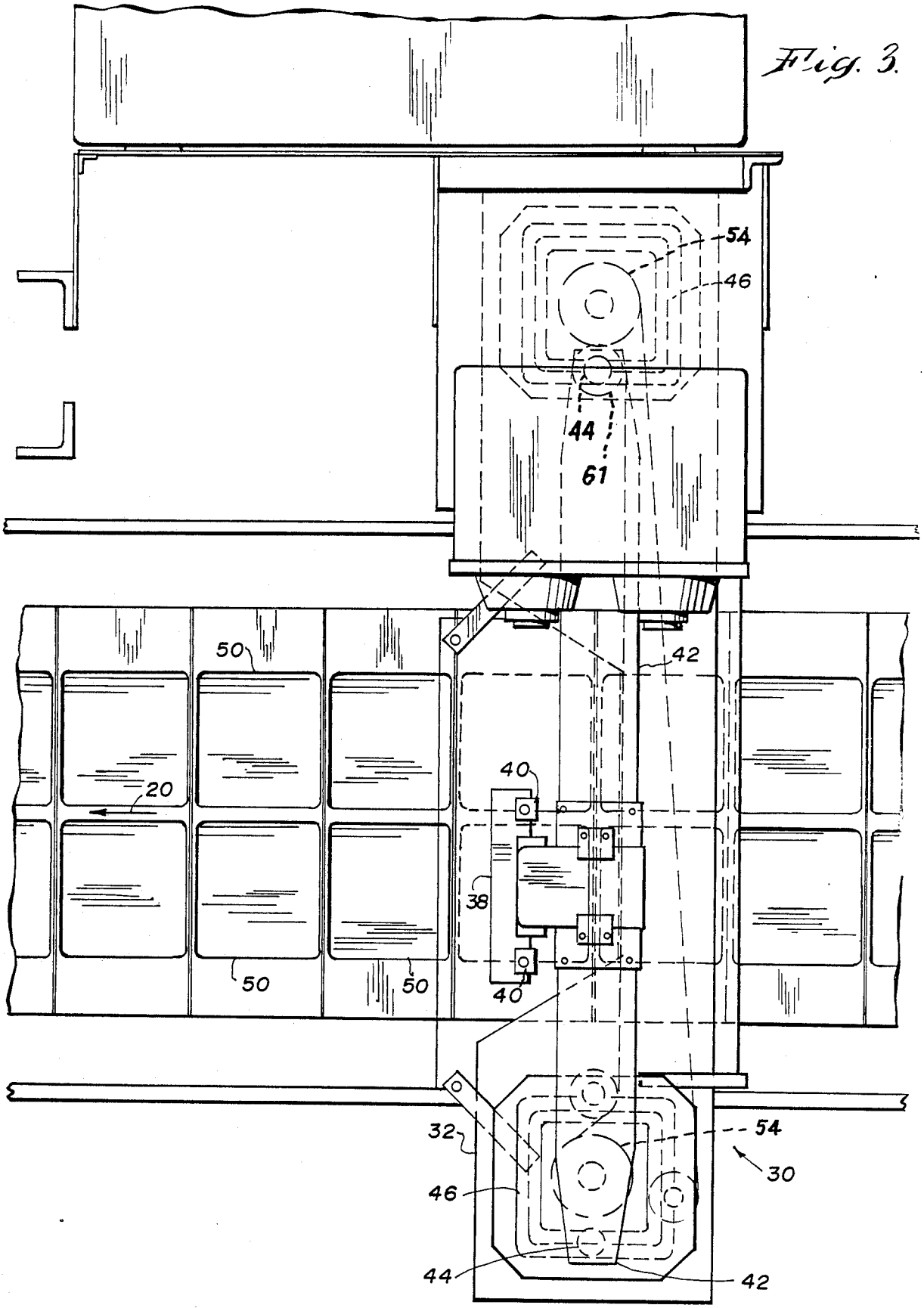
FIG. 3 is an enlarged hot melt adhesive applicator of the type employed in the apparatus illustrated in FIGS. 1 and 2.
Figure 4:
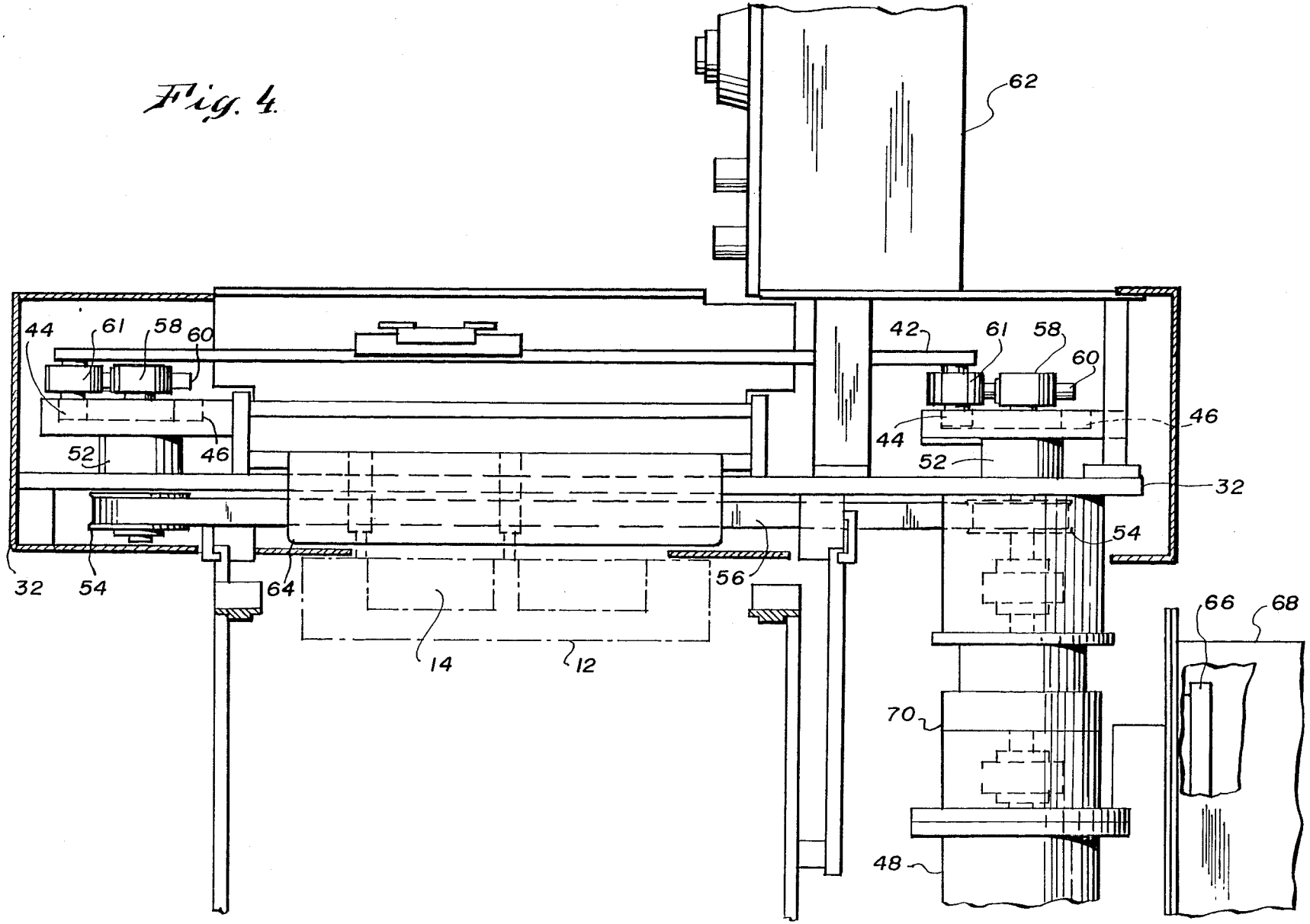
FIG. 4 is a side elevational view of the hot melt adhesive applicator illustrated in FIG. 4 having a separate motor drive.

Turning now to FIGS. 3 and 4, which illustrate one form of the adhesive applicator assembly 30 embodied in the present invention, two abreast dies 14 are utilized in the die train 12, two adhesive guns 40 are positioned on a common mount 38 which is attached to a bar 42. The bar 42 is attached pivotally at either end to a pair of cam followers 44 which travel in a pair of stationary cams 46 attached securely to the frame 32. The stationary cams 46 have a generally square track with rounded corners and center lines which match an adhesive line or path 50 corresponding to an adhesive pattern around 360° of the perimeter of the first plastic package component 26. The cams 46 are so shaped that the bar 46 carrying the adhesive guns 40 is forced to traverse the adhesive track or path 50 when the adhesive applicator assembly 30 is rotated.

As will best be seen in FIG. 4, a pair of vertical shafts 52 carrying timing sprockets 54 at their lower ends have the sprockets securely journalled in the frame 32. The timing sprockets 54 are coupled together by a timing belt 56 and are thereby forced to rotate in unison. The vertical shafts 52 carry cross heads 58 at their upper ends. Each cross head has a rod 60 journalled therein; these rods are fixedly attached to blocks 61 containing bearings rotating on the same center line as the cam followers 44.

One of the two vertical shafts 52 is driven by a separate drive motor 48 which is illustrated in the separate drive motor of FIGS. 1–7. As will be explained hereinafter, the adhesive applicator assembly 30 may alternatively be driven by flexible shafts or other conventional drive means from the parent packaging machine crank shaft drive.

As will be explained more in detail hereinafter, the adhesive applicator 30 is driven at a ratio of 1½ to 1 with respect to the drive to the parent packaging machine 10. Accordingly, for each full revolution of the vertical shaft 52, the adhesive guns 40 traverse the periphery of each package laying down an adhesive line 50 being guided thereby by the bar 42 tracing a pattern governed by the track in the cam 46. It will be understood that to lay down the adhesive around the package being formed, each full revolution of the vertical shaft 52 must be accomplished during the dwell portion of the dies 14 of the packaging machine 10 while they are stopped and in position under the applicator guns 40. If the two adhesive guns 40 are activated and open during the full rotation of the vertical shafts 52, the two adhesive paths 50 will be applied around the peripheries of the two cavities in the dies 14. In actual practice, it is customary to keep the adhesive guns 40 open during a little more than 360° of rotation in order to provide a slight overlap and insure that there will be no gap in the adhesive lines 50 in the places where the guns 40 start to deposit adhesive as well as where the guns stop depositing the adhesive.

As seen in FIG. 4, the adhesive applicator station B includes the control cabinet 62 as well as an electrical panel assembly 66 which is enclosed by an electrical enclosure assembly 68. A safety gate assembly 64 protects the adhesive applicator 30 in the machine direction.

As has been pointed out, most high speed production type packaging machines, whether of the non-die train type or the die train type, utilize intermittent motion apparatus in which components of the package are indexed between a plurality of stations, and are stationary in those stations while a packaging operation is performed. Usually, a five-station Geneva drive is used to drive machines of both types and the drives of these machines are essentially the same as illustrated in the aforesaid U.S. Pat. No. 3,061,984. The five-station Geneva drive is utilized to illustrate the present invention because it provides an optimum time distribution between index (108°) and dwell (252°) consistent with other requirements for the vacuum packaging cycle. However, it should be appreciated that machines equipped with conjugate cam indexers which provide somewhat smoother acceleration and deceleration of the intermittent motion parts than the fivestation Geneva drive may be utilized with the present invention. No matter which type of drive is selected for the packaging cycle, the hot melt adhesive must be laid down during the dwell time which in this instance has been selected at being 252°, but it will be apparent to those skilled in the art that other time distributions can be accommodated in utilizing the principles of the present invention.

The described apparatus may utilize two different drives for the traverse of the adhesive applicator 30, both of which will be described in relation to 108° vs. 252° timing. As already described in connection with the embodiments illustrated in FIGS. 1–4, a separate motor drive is utilized for driving the adhesive applicator 30 utilizing a variable speed motor 48 coupled by a reduction gear mechanism 70 to one of the timing sprockets 54 driving the timing belt 56. The speed capabilities of the motor 48 are selected so that it is capable of driving the adhesive applicator 30 through 360° plus an overlap angle X during 252° of machine rotation corresponding to the dwell time for the highest speed at which the packaging machine 10 will run. Accordingly, for this predetermined speed of driving the applicator 30, it is only necessary to open the valves of the applicator 30 at the beginning of the dwell time and to close them again at the conclusion of the dwell time.

It has been found that precise repetitive overlap angles X can be reproduced for each speed adjustment of the packaging machine 10. The speed of traverse of the adhesive applicator also can be easily adjusted by simple observation of the adhesive lines 50 for each speed of the packaging machine 10 within its speed range. The motor 48 continuously operates at a uniform speed thereby continuously driving the adhesive applicator 30 at uniform speed regardless of whether the packaging machine 10 is in its index or dwell time mode. This departs significantly from previous approaches where the traversing motion of the adhesive guns was intermittent thereby first requiring the guns to accelerate to a uniform application speed, then to open the guns while traversing 360° plus X overlap degrees at uniform speed, and then decelerate. Such intermittent stopping and starting required expensive and elaborate machinery and controls and also introduced a great deal of vibration limiting the speed of the machine and providing shorter machine life and higher maintenance costs when contrasted with the continuous motion applicator head of the present invention.

Figure 5:
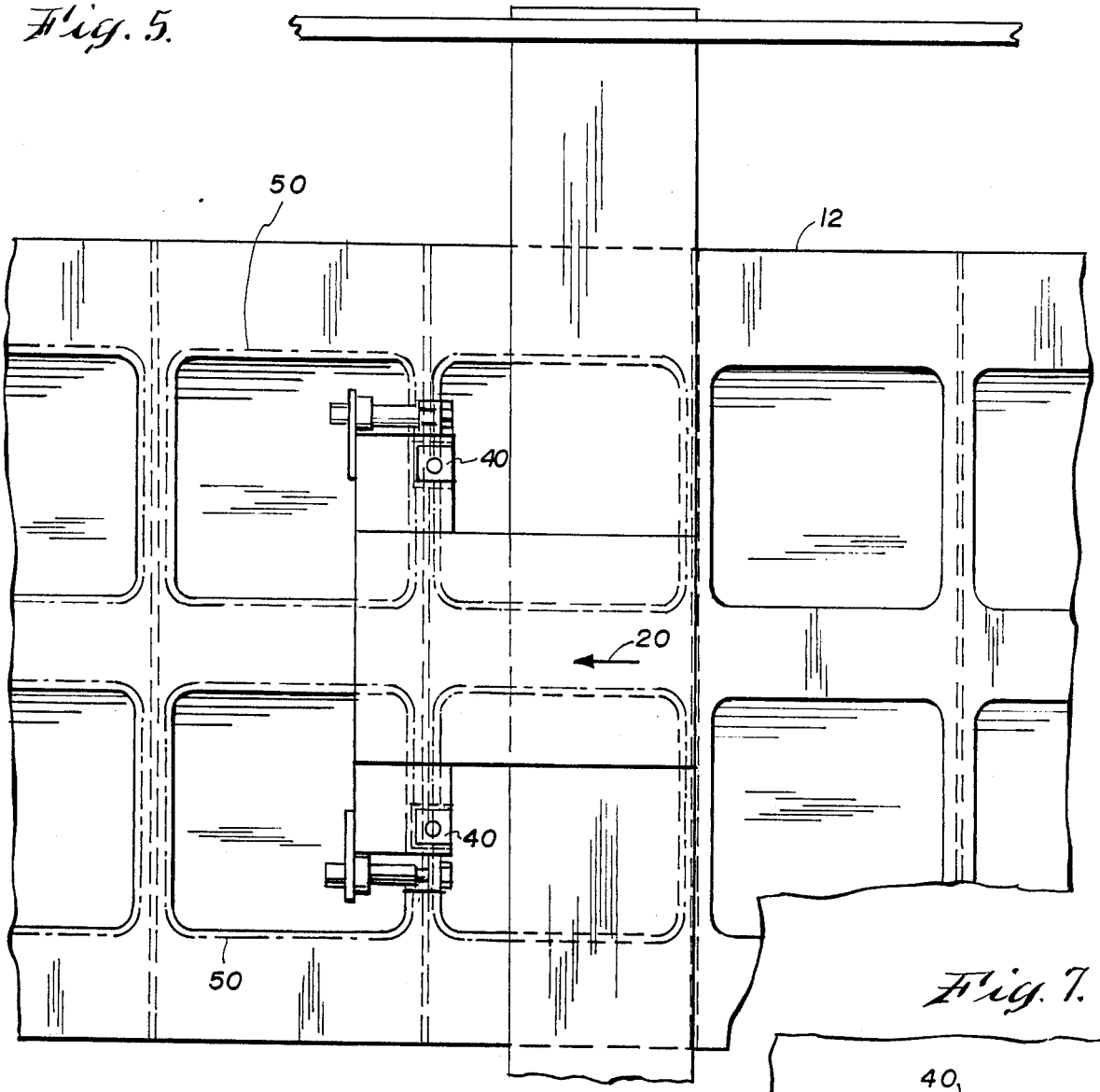
FIG. 5 is an enlarged top plan view of the adhesive applicator head in FIG. 4.
Figure 7:
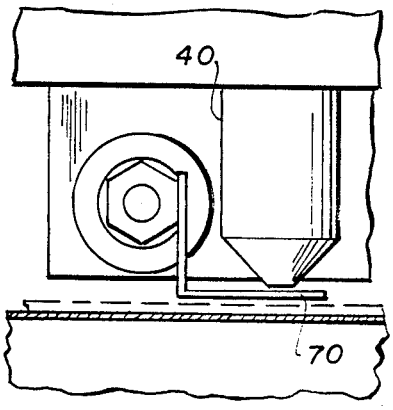
FIG. 7 is an enlarged side elevational view taken along line 7—7 of FIG. 6.
Figure 6:
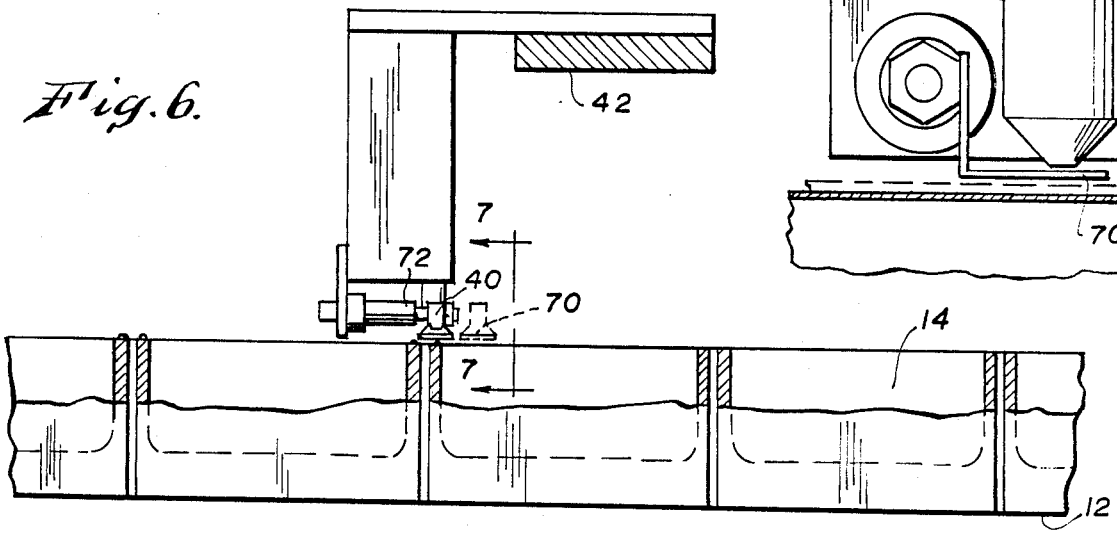
FIG. 6 is a elevational view of the adhesive applicator head shown in FIG. 5.

With the continuous movement of the adhesive applicator 30 and the indexing movement of the packages being processed, it has been found that under certain circumstances, and with certain types of hot melt adhesive, the adhesive may drip from the guns 40 inside the adhesive line or path 50 and/or on the products in the packages during the periods when the guns should be closed and during the indexing of the packaging machine 10. In the embodiment illustrated in FIGS. 1–4, where the continuous drive of the adhesive applicator 30 is provided by separate motor drive 48, there is no fixed angular relationship between the machine and the applicators, and accordingly there are no repetitive series of positions where the adhesive may drip inside the package seals. The problem is handled in this case by placing an intermediary device beneath the adhesive guns 40 which will catch the occasional drips and prevent contaminations thereby. As is illustrated in FIGS. 5, 6, and 7, the intermediate devices for this embodiment are in the form of a pair of movable shutters 70 which may be actuated by a pair of air cylinders 72. The shutters 70 are actuated whenever the adhesive guns 40 are closed. The shutters 70 are mounted on the bar 42 and move with the guns 40. FIG. 7 illustrates the shutter 70 in its actuated position covering the nozzle of the gun 40 to prevent any adhesive from falling on the food being packaged or on areas which may prove troublesome in the final evacuation and sealing of the package. FIG. 6 illustrates, in dotted form, the deactivated position of the shutter 70 permitting the adhesive gun 40 to dispense adhesive. The actuation of the gun 40 for dispensing adhesive is timed from the packaging machine 10.

Figures 8, 9, 11:
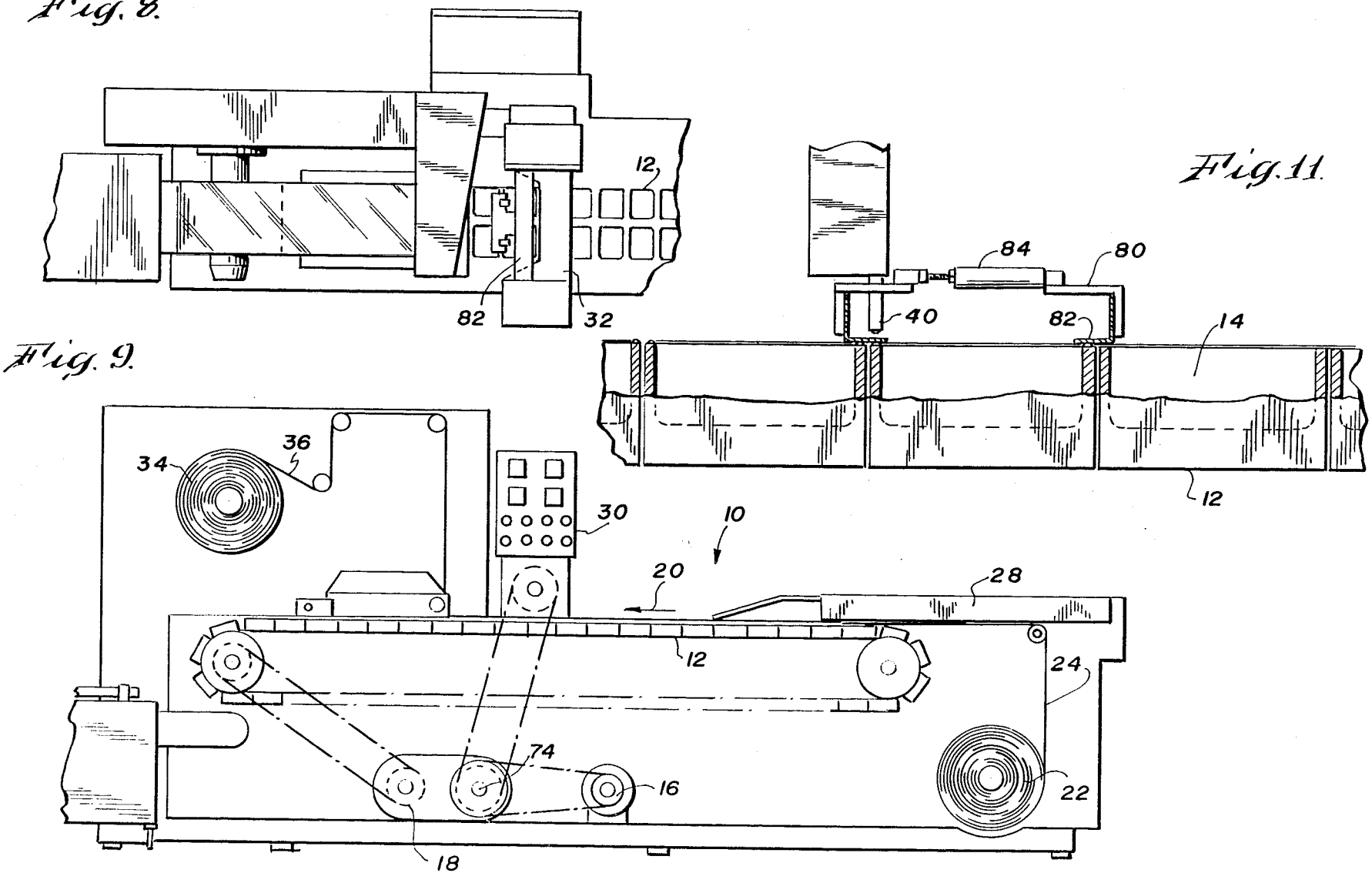
FIG. 8 is a top plan view of a packaging apparatus employing a direct machine drive for the applicator head.
FIG. 9 is a side elevational view of the packaging apparatus illustrated in FIG. 8 showing the packaging apparatus employing a direct machine drive for the applicator head.
FIG. 11 is a cross-sectional view taken along lines 11—11 of FIG. 10.

The embodiment illustrated in FIGS. 8 and 11 is similar to the embodiment illustrated in FIGS. 1–7 except that the continuous drive for the adhesive applicator 30 is directly derived from one of the continuously driven shafts of the packaging machine 10. As is shown in FIG. 9, shaft 74 driven by the packaging machine motor 16 provides the drive for the adhesive applicator 30 with suitable speed reduction as required for driving the vertical shafts 52 controlling the speed of the adhesive applicator 30. Merely as an operative example, under some circumstances the drive of the adhesive applicator 30 may be provided from a shaft corresponding to shaft 32 in U.S. Pat. No. 3,061,984 with a ratio which will drive the applicator guns 360° plus X degrees for each 252° dwell time of the packaging machine 10. If X is selected as 5°, this ratio would be approximately 522° of the applicator gun for each 360° revolution of the drive of the packaging machine 10. In practice a more convenient ratio exceeding the minimum may be selected which will result in the minimum practical speed of the applicator 30. By increasing the speed ratio slightly to 1½ to 1 (540° to 360°) a sequence of gun 40 positions may be obtained so that the positions repeat themselves every two machine cycles. This repetitive sequence may be used advantageously to correct any adhesive drip inside the packages or inside the seal line which problem has already been discussed in connection with a separate direct drive for the applicator heads.

Figure 13:
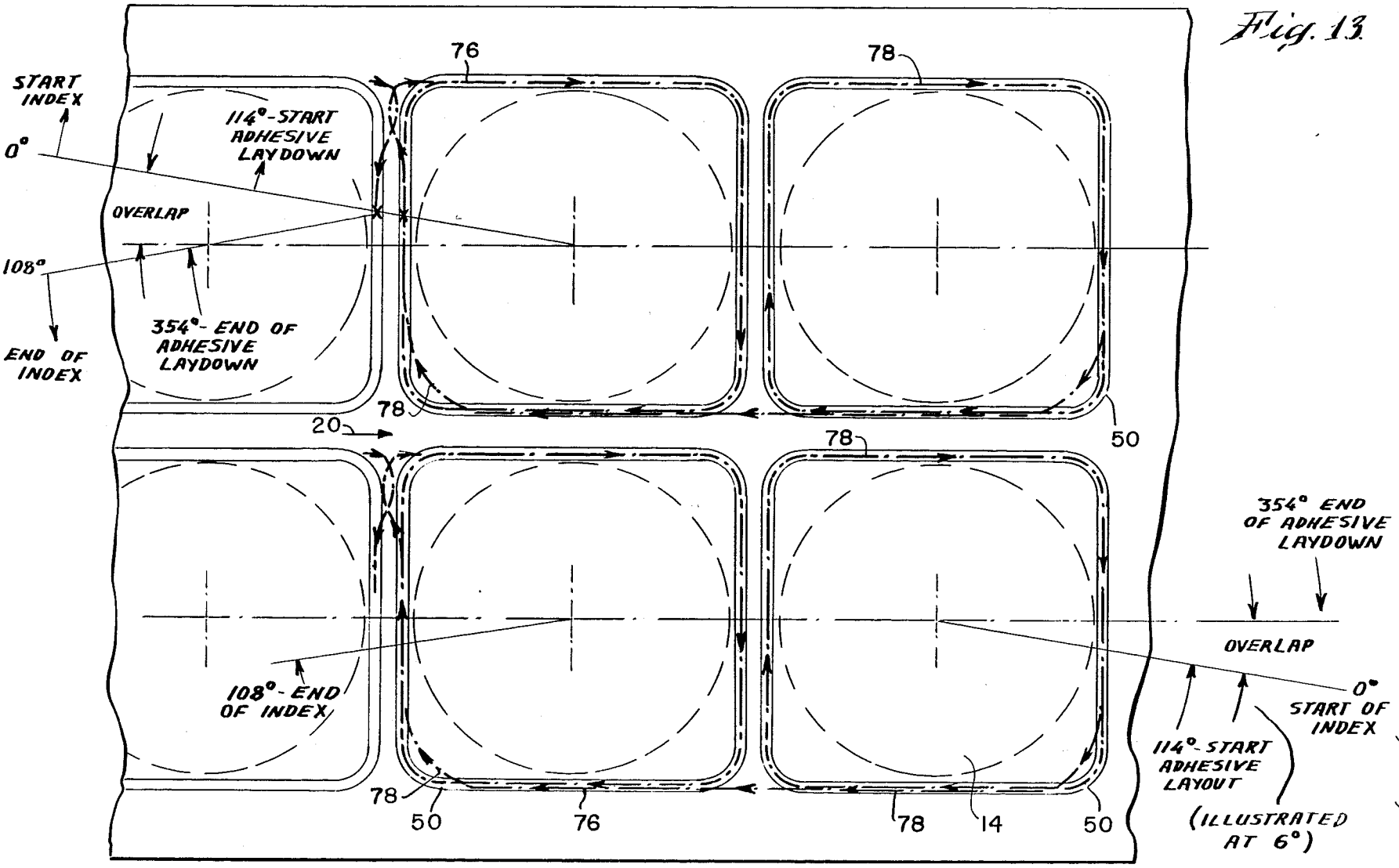
FIG. 13 illustrates the trace pattern of the continuously direct machine driven applicator heads during the indexing cycle of the packaging apparatus of the present invention.

In protecting against adhesive drip, it is advantageous to use a drive ratio which brings about repetitive adhesive gun 40 angular positions sufficient to produce 360° plus X degrees revolution f the guns while the packaging machine 10 passes through the 252° of dwell. The ratio of 540° to 360° (1½ to 1) causes this condition which minimizes the areas of drippage within the adhesive line 50 and drippage on the product. This particular angular relationship is illustrated in FIG. 13 wherein the adhesive guns 40 rotate 540° for each machine cycle, and the degree rotations coincide with the 360° machine timing cycle as distinguished from geometric degrees. As will be seen in FIG. 13, the position of the adhesive guns 40 relative to the position of the dies 14 repeats itself every two indexes as illustrated by the trace path 76 of the gun and alternate trace path 78. Viewing FIG. 13 in the machine direction 20, the zig-zag lines at the lower left during one index representing the gun 40 positions, presents no danger at all of dripping on a round product, a square product or anywhere inside the seal area. However, in the following index, the dotted lines at the lower and upper right hand show that drippage may occur in the extreme right hand corners of a square product, and a little inside the adhesive seal line 50, but obviously not on a round product. Accordingly, this selected angular relationship minimizes the danger of drippage particularly on a round product. As illustrated in FIG. 13, this particular angular relationship is an advantage in evacuation and sealing which will be explained hereinafter in view of the fact that the overlap X always occurs generally perpendicular to the machine direction 20 and never adjacent an evacuation slot which is located between dies 14 in the machine direction 20.

Figure 10:
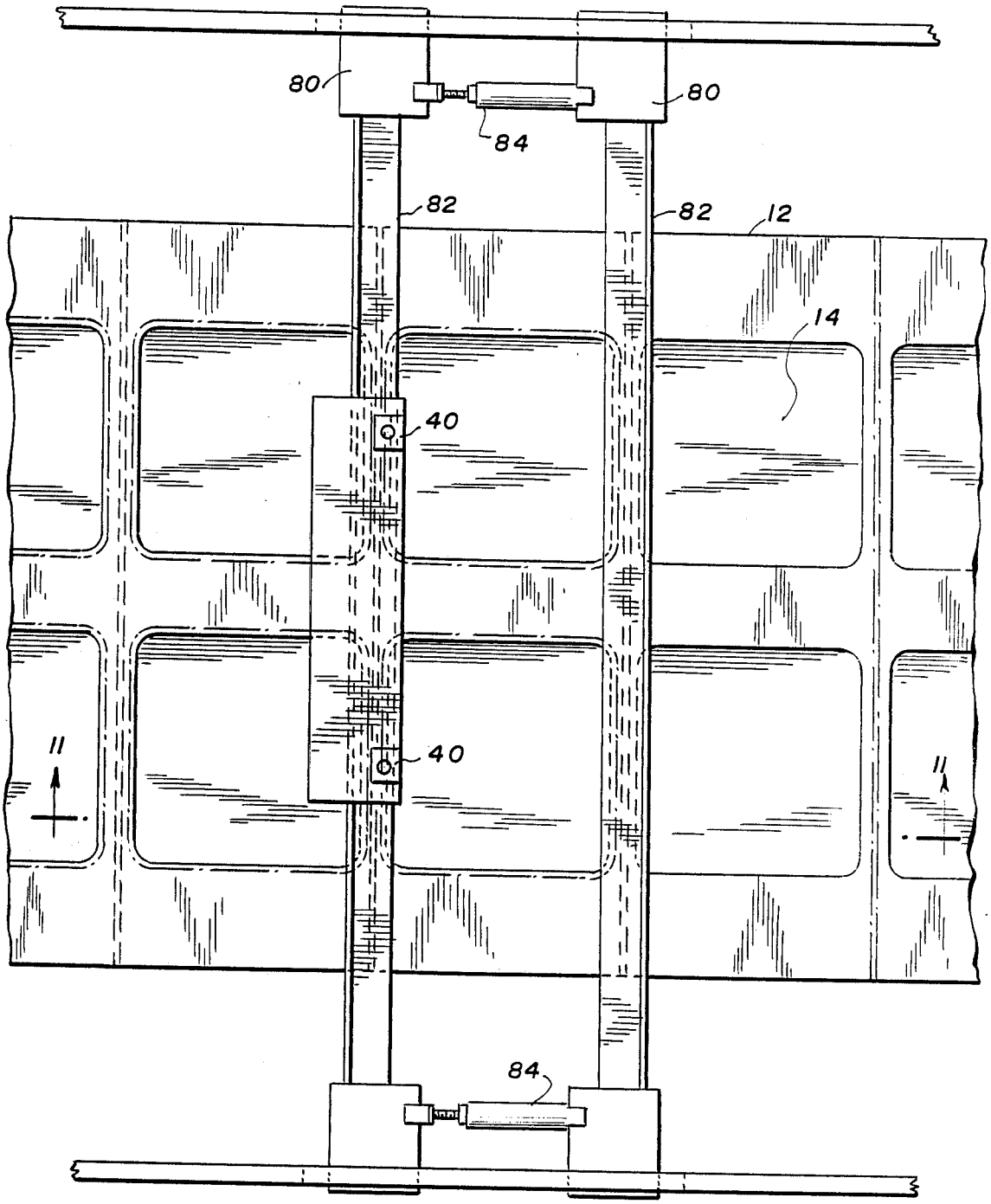
FIG. 10 is an enlarged top view of the adhesive head applicator employed with the direct machine drive.

Since the sequence of the adhesive gun 40 positions repeats every two machine cycles, and because the alternate cycle positions of the danger zone occur in the upper right and lower right hand corners looking in the machine direction 20 of FIG. 13, a simple stationary intermediate device mounted as shown in FIGS. 10 and 11 may be employed. In this embodiment the intermediate device consists of a support 80 carrying a shutter 82 which is actuated by an air cylinder 84, and the entire structure can be mounted on the stationary frame 32 in the applicator station B. The shutter 82 only needs to be activated during each alternate cycle and can be mounted directly on the frame of the packaging machine or on the frame of the adhesive applicator. FIG. 11 illustrates the shutter 82 activated in position under the adhesive gun 40 preventing dripping on the product when in the activated position. It is also possible to use the intermediate device of FIG. 10 with the separate motor drive embodiment shown in FIGS. 1–4, if the machine drive and separate drive having the proper ratio to provide repetitive repeat traversal paths of the guns 40. Of course, it is always possible to use the shutter travelling with the head on the direct motor drives, but the embodiment illustrated in FIG. 10 is simpler and requires actuation only on alternate half cycles.

Currently, the most widely used type of vacuum packaging machine for uniformly sized products such as sliced luncheon meats, frankfurters and the like, for high speed, high production operation is the die-train type apparatus closely resembling that shown in previously mentioned U.S. Pat. No. 3,061,984. The most efficient and widely used form of this type of machine uses dies such as shown in FIGS. 7 and 11, with the packages being formed thereby evacuated through a central confined passageway between the dies using web lifters or sheet separators 90. The web lifters 90 are made to move freely in the passageway between the dies and occupy a lower position when cutting an evacuation slot and an upward position during evacuation for example, as is illustrated in FIGS. 8 and 11 of the aforesaid patent.

A problem arises using desirable types of pressure sensitive hot melt adhesives when using the structure similar to that employed in the aforesaid patent. When the top web or cover sheet is fed to the packaging operation adhesion occurs between the top web and the flange containing the sealing line of pressure sensitive adhesive which extends 360° around the peripheries of the cavities in the bottom web. Obviously, when bringing the two webs in close proximity, some adhesion occurs between the top and bottom webs along the normally unsealed portions of the package even though no pressure sensitive bar or other sealing pressure has yet made contact with such areas which, of course, is being caused by the presence of hot melt adhesives.

Accordingly, when the sheet separator 90 rises in the conventional manner, the partially sealed areas are reopened so that air from the interior of the two packages may be evacuated and passed out and down the sheet separator openings through which the sheet separators 90 extend. The reopening of the closed portions of the packages by the sheet separator causes stringing of the adhesive to form between the top and bottom webs on either side of the sheet separator providing adhesive legs therebetween. When the package is evacuated, the air leaving the two package interiors because of the evacuation process passes through the restricted openings at high speed impinging on the stringing adhesive legs between the two webs breaking some, stretching others and tearing these legs of adhesive inward toward the evacuation slots and down into the restricted sheet separator passages thereby fouling the sheet separator, the surface and the passageways of the dies and requiring periodic shut-down for machine clean-up which slows the entire packaging process and limits the effectiveness and efficiency of the packaging machine. This problem may be alleviated in the manner which will be described hereinafter.

Figure 12:
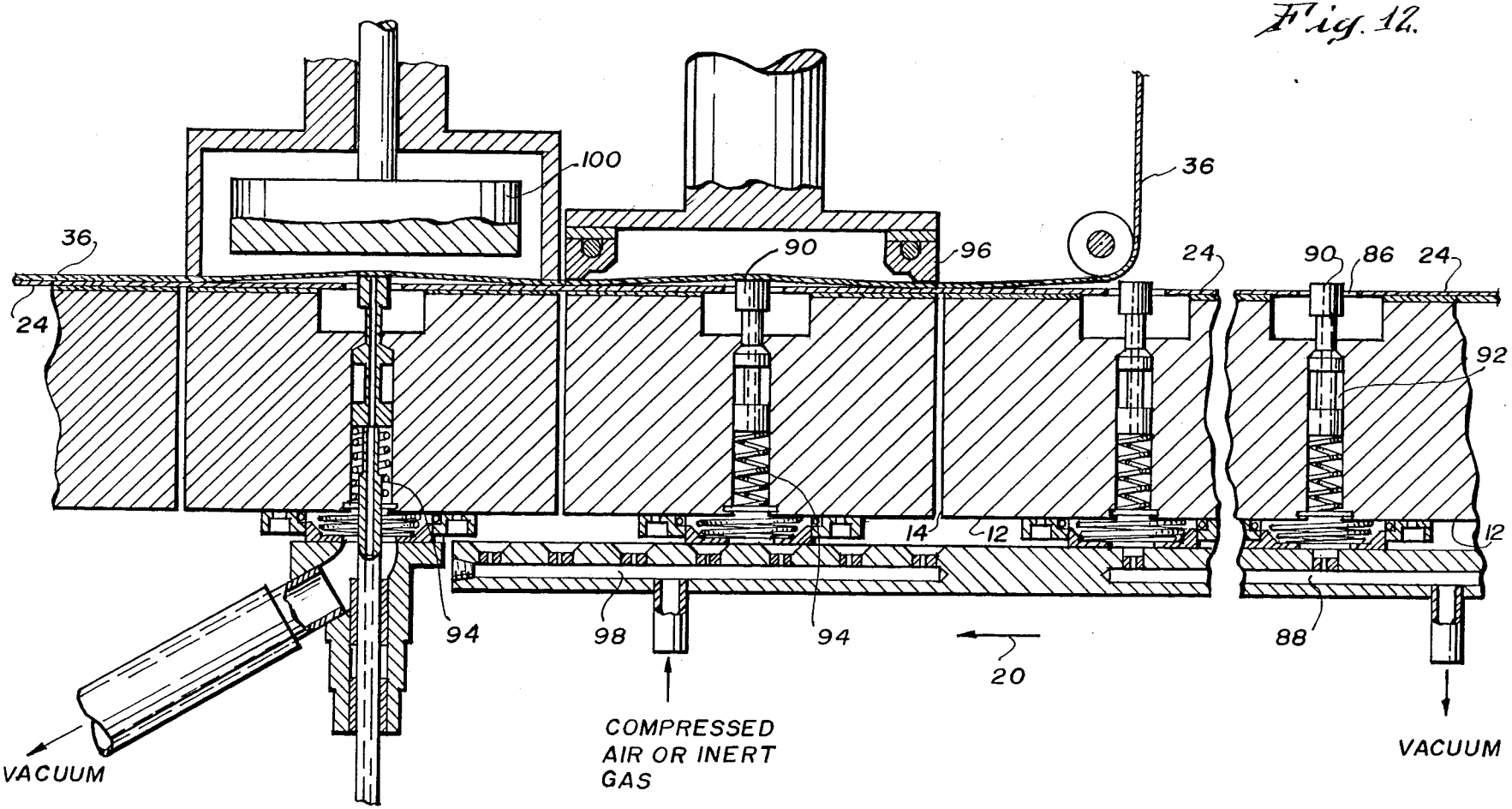
FIG. 12 is a cross-sectional view of an evacuation station of the packaging apparatus which may be used in the present invention.

Referring now to FIG. 12, the die train 12, when indexed through the packaging machine 10, is exposed to a holding vacuum applied through a manifold 88 through passageways 92 containing the web lifters or separators 90 and evacuation slots 86 which are in communication with the internal portions of the dies 14 holding the first plastic package components 26. This vacuum holds the first plastic package component 26 in place as they move through the packaging apparatus 10.

The adhesive stringing problem is alleviated by keeping the top web cover or second plastic package component 36 from touching the adhesive 50 on the first plastic package component 26 in the critical areas. As the die train 12 is indexed in the machine direction 20 to the central portion illustrated in FIG. 12, the web separator 90 bears on the underside of web 36 in the critical area and is spring biased upward by a spring 94 to prevent the top web or second package component 36 from touching the adhesive 50 which has been laid down between the dies 14 in the machine direction near' the evacuation slots 86. It will be apparent that devices such as latches, friction devices, etc. may be employed for the spring biasing as long as the top web 36 is prevented from touching the adhesive line 50 on the bottom web in the critical central areas where evacuation takes place. In the aforesaid central index position, shown in FIG. 12, a clamp 96 brings the upper web 36 into contact with the lower first package component 26 around the outer peripheries of the two package array to ready the packages for evacuation through passages between the dies 14.

Another method of alleviating the adhesive stringing problem is to provide a manifold 98 and to apply therethrough a source of compressed air or inert gas through the lifter passageway 92 in the evacuation slot 86 so that the air or gas pressure serves to cause the top web 36 to tent upward thereby minimizing the adhesive contact of the top web 36 in the critical central area between the dies where evacuation is to take place on the next index of the machine. The package is then evacuated after which a longitudinal sealing bar 100 is lowered between the packages so formed, completing and totally sealing the package.

Another method of alleviating the adhesive contamination problem is to space the adhesive line 50 further away from the evacuation openings 86, and it has been found that a distance of no less than ⅜ of an inch may be utilized to produce satisfactory results. However, increased distance in the case of center evacuation results in packaging material wastage which is undesirable. Adhesive stringing and the resultant machine contamination can also be alleviated by minimizing the amount of adhesive used particularly on the seal lines 50 adjacent the evacuation slots 86. Adhesive buildups can be minimzed by avoiding placement of the overlap area X in this area by using a direct drive with a ratio of 1.5 to 1 as explained above so that the overlap region will occur generally perpendicular to the machine direction 20 and never along the machine direction. Accordingly, adhesive buildup will not occur adjacent the evacuation slots in the critical areas.

It will be apparent to those skilled in the art that one or more of the above methods may be utilized in combination to reduce any adhesive contamination problems of the packaging machine. It should also be noted that the problem of stringing and adhesive contamination is more deleterious when running a semi-rigid top web than when running a flexible top web because the semi-rigid top web presses down harder thereby increasing the amount of stringing in the absence of the measures taken above to alleviate such problems.

Accordingly, a package method and apparatus has been described which will produce sealable and resealable packages utilizing a practical efficient, and repetitive hot melt applicator process. The packaging machine will accommodate an all flexible package made with adhesives as well as such a flexible package in which one component of the package is fabricated by back-forming. The process also will accommodate semi-rigid package materials as well as the combination of semi-rigid and flexible packaging materials in various combinations. A major feature of the methods and apparatus embodied in this invention involves driving an adhesive applicator with a continuous uniform motion which does not require the acceleration, deposit and deceleration cycle normally employed in hot melt adhesive machines of this type. The continuous uniform motion which is applied to the adhesive applicator may be provided by a separate motor drive or a direct drive utilizing one of the crank shafts of the packaging machine. The applicator assembly is extremely narrow in the machine direction of the packaging machine permitting it to be mounted and the adhesive applied deep into the packaging cycle near the application of the cover, evacuation, and sealing of the package so that the hot melt adhesive does not have to be reheated and activated in order to efficiently seal the package. Methods and apparatus are provided for effectively alleviating any adhesive problem caused in the evacuation process.

Since other changes and modifications varied to fit particular operating requirements and environments will be apparent to those skilled in the art, the invention is not considered limited to the examples chosen for purposes of of illustration, and includes all changes and modifications which do not constitute a departure from the true spirit and scope of this invention as claimed in the following claims and equivalents thereto.

We claim:

1. In packaging apparatus of the type for forming packages comprising a plastic cup-shaped container with a top sealed thereto around a seal line in a peripheral area of the container, the apparatus including means to support said cup-shaped containers and to move them through a number of operating stations; said apparatus comprising:

adhesive applicator means at a first operating station to lay down hot melt adhesive around the seal lines of said containers;

said applicator means including a gun mounted for movement around the complete periphery of each container to lay down adhesive around that periphery while the container is stopped in said first operating station;

means at a second operating station to lay down a plastic sheet over said containers to form tops thereover;

movable intermediate means actuable into a position beneath said adhesive applicator means to prevent adhesive from dripping down onto a package or product therebeneath;

means for de-activating said intermediate means to move it away from said position beneath said adhesive applicator means whenever said gun is actuated to dispense adhesive, thereby to permit an adhesive application to be made;

means for activating said intermediate means to its drip-preventing position when said gun has been de-actuated after an adhesive application has been made by said applicator means and to de-activate said intermediate means prior to the next actuation of said gun for the next application of adhesive; and means operable after the application of adhesive to complete the sealing of the packages.

2. Apparatus as claimed in claim 1, wherein said intermediate means comprises a movable shutter fixedly secured to said adhesive applicator for movement therewith around the periphery of each container; and means for actuating said shutter into a position beneath the nozzle of the gun whenever the gun is closed.

3. Apparatus as claimed in claim 2, wherein said actuating means comprises an air cylinder.

* * * * *